US006428421B1

(12) United States Patent
Halfacre

(10) Patent No.: US 6,428,421 B1
(45) Date of Patent: Aug. 6, 2002

(54) GOLF TRAINING AID

(76) Inventor: Ronald C. Halfacre, 1284 Halfacre Rd., Newberry, SC (US) 29108

( * ) Notice: Subject to any disclaimer, the term of this patent is extended or adjusted under 35 U.S.C. 154(b) by 0 days.

(21) Appl. No.: 09/630,493

(22) Filed: Aug. 2, 2000

(51) Int. Cl.[7] ..... A63B 57/00; A63B 69/36; A63B 53/06; A63B 53/16

(52) U.S. Cl. ..... 473/215; 473/207; 473/277; 473/266

(58) Field of Search ..... D21/791; 473/219, 473/223, 231, 257, 261, 264, 265, 266, 269, 270, 271, 272, 275, 277, 276, 207, 215, 218, 216, 243, 258, 263, 436, 450, 452, 458, 461, 471, 518; 2/919, 908, 24; 128/869

(56) References Cited

U.S. PATENT DOCUMENTS

| | | | | | |
|---|---|---|---|---|---|
| 2,228,586 | A | * | 1/1941 | Protzky | 473/518 |
| 3,190,658 | A | * | 6/1965 | Kane | 473/227 |
| 3,516,668 | A | * | 6/1970 | Kirk | 473/518 |
| 4,988,100 | A | * | 1/1991 | Shu et al. | 473/531 |
| 5,026,066 | A | * | 6/1991 | Kane | 473/227 |
| 5,303,927 | A | | 4/1994 | Perry et al. | |
| 5,308,074 | A | | 5/1994 | Dorotinsky et al. | |
| 5,390,929 | A | | 2/1995 | Todaro | |
| 5,456,470 | A | | 10/1995 | Scheurer | |
| 5,687,422 | A | * | 11/1997 | Wurst et al. | 2/24 |
| 5,718,640 | A | | 2/1998 | Noblin | |
| 5,762,565 | A | | 6/1998 | Milam et al. | |
| 5,803,822 | A | | 9/1998 | Pursell | |
| 5,893,366 | A | * | 4/1999 | Odell et al. | 128/869 |
| 5,919,097 | A | * | 7/1999 | Cole | 473/212 |
| 5,924,933 | A | | 7/1999 | Pacheco | |
| 5,984,797 | A | | 11/1999 | Kessler et al. | |
| 6,024,656 | A | | 9/2000 | Lane | |
| 6,129,638 | A | * | 10/2000 | Davis | 473/215 |

* cited by examiner

*Primary Examiner*—Paul T. Sewell
*Assistant Examiner*—Alvin A. Hunter, Jr.
(74) *Attorney, Agent, or Firm*—Timothy J. Slabouz; Nexsen Pruet Jacobs & Pollard, LLC; Michael A. Mann

(57) ABSTRACT

A golf training device to help maintain the proper synchronous relationship between the movement of hands and hip rotation during a golf swing. In the event that the movement of the hands and hip rotation of the user are out of synch, the training device provides feedback to the user. Device basically comprises a belt and strap that secure a sheet to the right leg of the user. A pair of panels is mounted to the sheet. Pair of panels contacts a user's hands if the hip rotation and the movement of the user's hands are out of synch.

14 Claims, 4 Drawing Sheets

GOLF TRAINING AID

BACKGROUND OF THE INVENTION

1. Field of the Invention

The present invention relates to golf training devices and in particular to devices for training proper hip rotation in making a golf swing.

2. Discussion of Background

Golfers have made numerous attempts to enhance the consistency with which contact is made with the club. Timing is essential to consistently hitting the ball in a relatively straight line. The relative movement of the golfer's hands with respect to the rotation of the golf's hips is particularly critical. Unless the golfer is able to sufficiently rotate the hips at the appropriate time, the club face will likely not be square at contact.

Typically, the golfer will go to a teaching pro to get advice regarding their swing. Unfortunately, this approach is very expensive since many teaching pros charge over $100 per hour for lessons. Another avenue that golfers take in hopes of achieving a more consistent game is trying the various training aids on the market. Again, many of these devices are very expensive to buy, are overly complex and do not provide the required feedback needed for improving consistency in the golfer's game.

Therefore, there exists a need for a simple and inexpensive device that provides instant feedback in determining whether the user has sufficiently rotated his hips during the swing and that the back swing is on line.

SUMMARY OF THE INVENTION

According to its major aspects and broadly stated, the present invention is a golf training device to help maintain the proper synchronous relationship between the movement of hands and hip rotation during a golf swing. In the event that the movement of the hands and hip rotation of the user are out of synch, the training device provides feedback to the user. Device basically comprises a belt and strap that secure a sheet to the right leg of the user. A pair of panels is mounted to the sheet. Pair of panels contacts a user's hands if the hip rotation and the movement of the user's hands are out of synch or if the club is taken off line during the back swing.

A major advantage of the present invention is its simplicity, both in use and structurally. A user of the present invention will be able to immediately use the device, without complex instruction. Moreover, the structural simplicity of the present invention allows for low manufacturing costs, unlike many complicated training aids.

An important feature of the present invention is the panels mounted to the user's leg. The panels provide instant feedback for the user, both during the back swing and follow through. The user is able to recognize that the hips must be rotated sufficiently so that the hands do not contact the panels.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
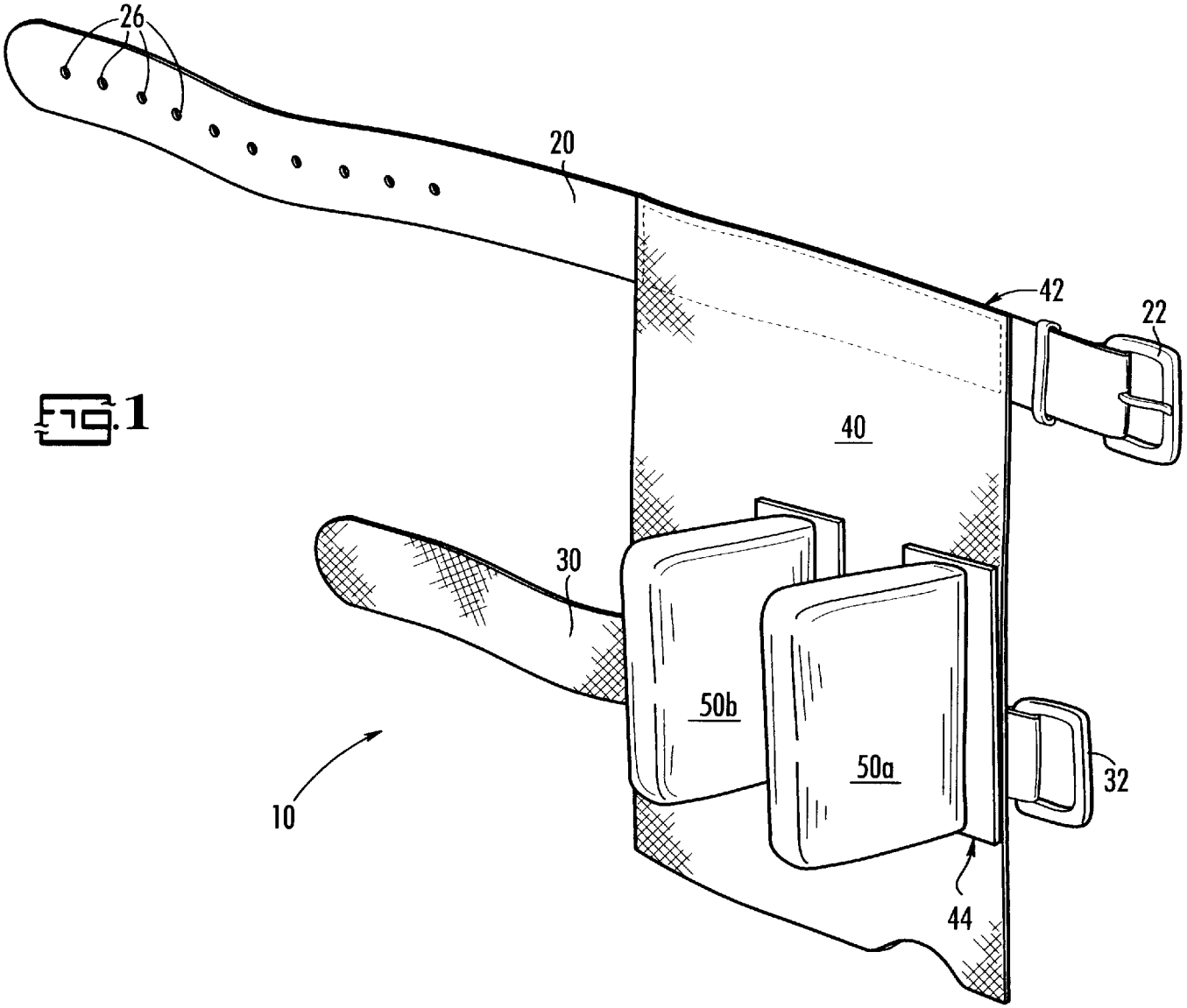
FIG. 1 is a perspective view of a golf training aid, according to a preferred embodiment of the present invention.

Referring now to the figures, the present invention is a golf training device. Device 10 helps maintain the proper synchronous relationship between the movement of hands 130 and hip rotation during a golf swing. In the event that the movement of the hands 130 and hip rotation of the user are out of synch, the device 10 provides feedback to the user. Device 10 basically comprises a belt 20 and strap 30 that secure a sheet 40 to the right leg 120*b* of the user 100. A pair of panels 50*a* and 50*b* are mounted to sheet 40. Pair of panels 50*a* and 50*b* contact a user's hand 130 if the hip rotation and the movement of the user's hands 130 are out of synch.

Figure 2:
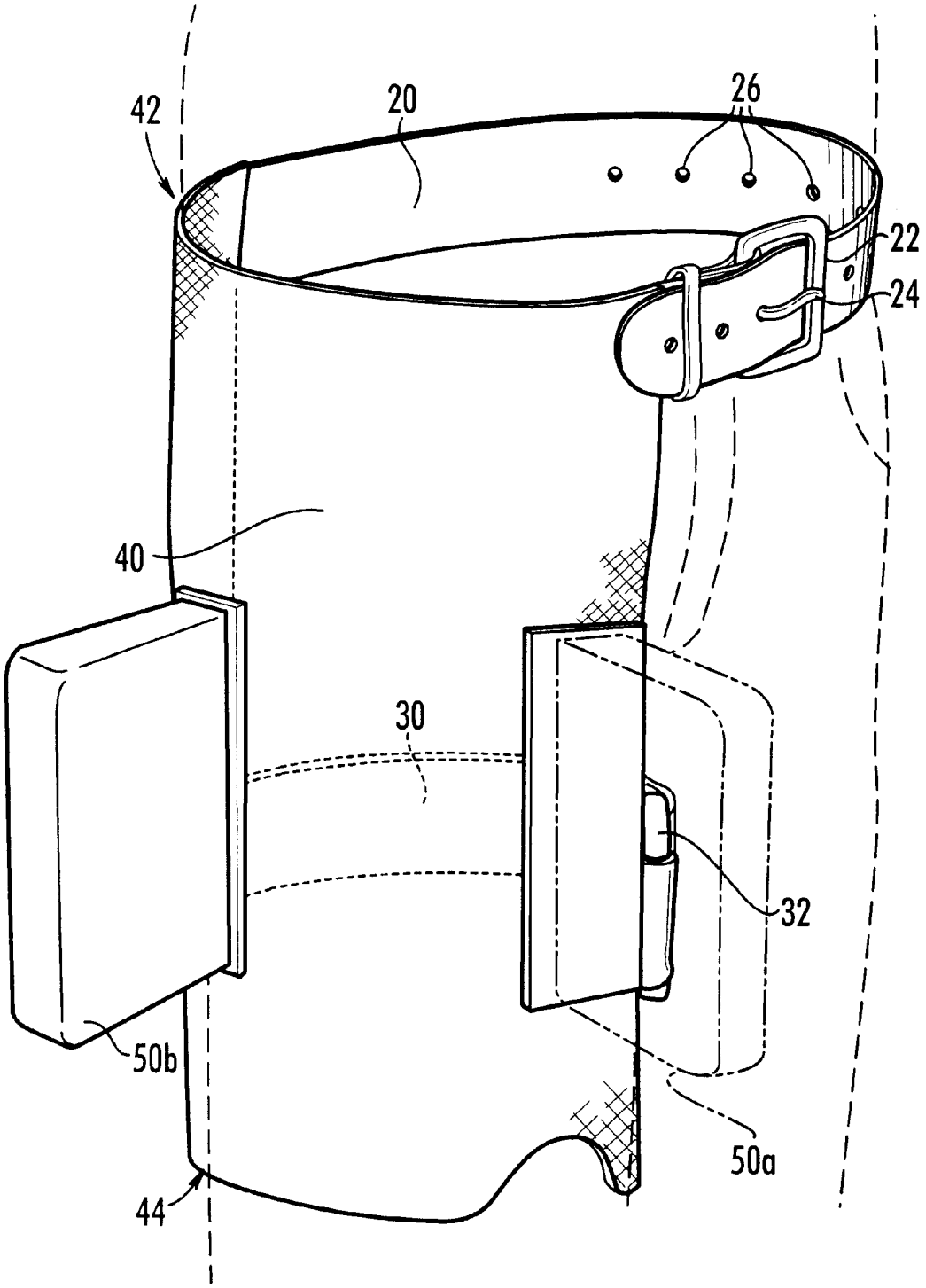
FIG. 2 is a perspective view of a golf training aid attached to a user, according to a preferred embodiment of the present invention.

Referring to FIG. 1, device 10 has a sheet 40 that can be attached a user using a belt 20 and a strap 30. Belt 20 is attached to the top end 42 of sheet 40 while strap 30 is attached to the bottom end 44 of sheet 40. Belt 20 has a buckle 22 on the first end and a plurality of holes 26 on the second end. Belt 20 functions like a standard belt and is capable of being wrapped around the waist of a user so that first end and second end can be fastened together. Strap 30 is capable of being wrapped around a leg 120*b* of the user 100 so that bottom end of sheet 40 is secured to the leg 120*b* of a user 100 as illustrated in FIG. 2. Strap 30 has a first end with hook and loop fasteners and a second end with a clasp 32. First end of strap 30 is capable of being received through clasp 32 and secured using hook and loop fasteners. Sheet 40 may be secured to a user 100 as illustrated in FIG. 2.

A first panel 50*a* and second panel 50*b* are mounted to sheet 40. Panels 50*a* and 50*b* may be mounted to sheet 40 using a variety of techniques, however, panels 50*a* and 50*b* preferably are attached to sheet 40 using hook and loop fasteners. Panels 50*a* and 50*b* have a major dimension that extends from the leg 120*b* of the user 100 when panels 50*a* and 50*b* are mounted to the leg 120*b* of the user 100. First panel 50*a* is preferably mounted to sheet 40 so that first panel 50*a* extends in a direction perpendicular to the intended ball flight path as illustrated in FIG. 2. The term "intended ball flight path" means the horizontal straight line path between the user and the intended target. Second panel 50*b* is preferably mounted in a position perpendicular to first panel 50*a*.

Figure 4:
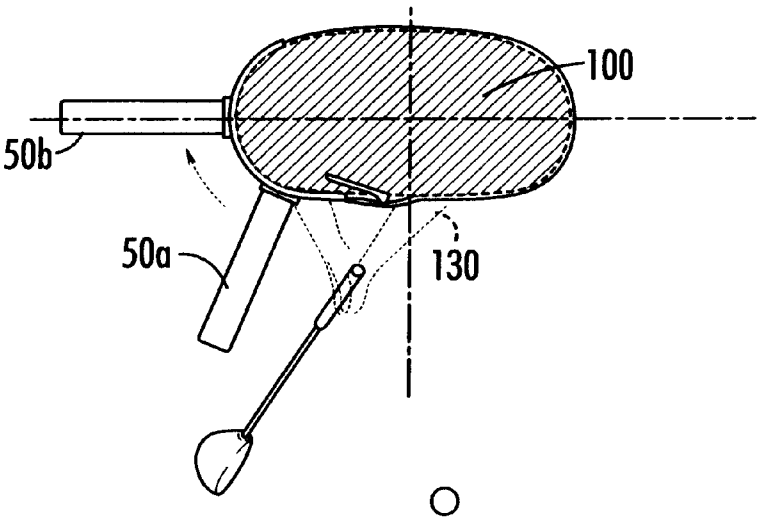
FIG. 4 is a top view of a user using golf training aid during the initial portion of the back swing, according to a preferred embodiment of the present invention.
Figure 3:
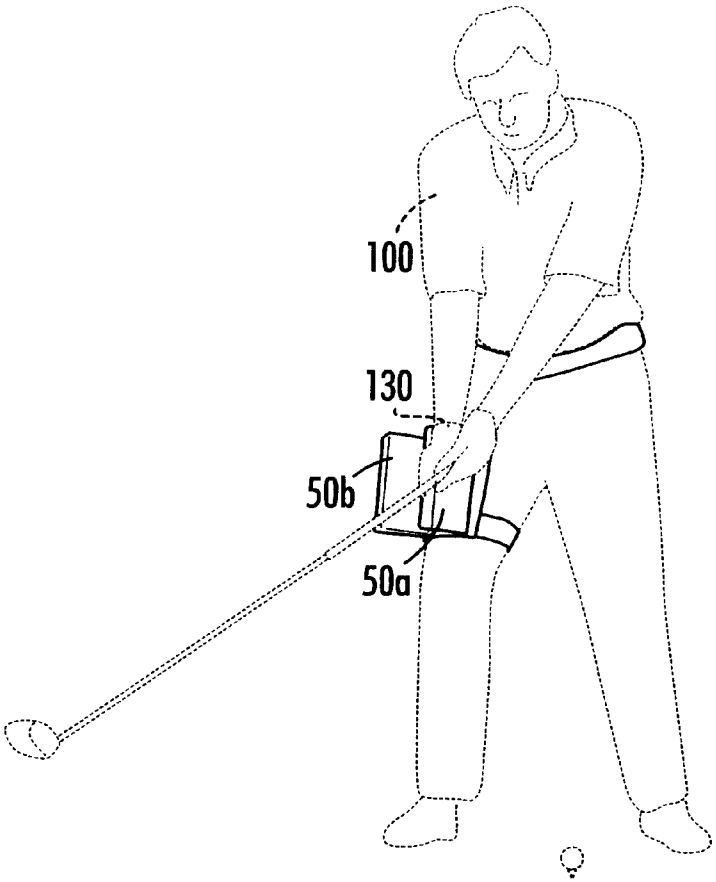
FIG. 3 is a side view of a user using golf training aid during the initial portion of the back swing, according to a preferred embodiment of the present invention.

Referring to FIGS. 3 and 4, there is shown the relative position of user's hands 130 with respect to first panel 50*a* initially starting back swing. Preferably, the back swing of user 100 is on a line that is sufficient to clear first panel 50*a* from hands 130 of user 100; otherwise, the hands 130 of the user 100 will contact first panel 50*a*. In other words, hands 130 of user 100 will contact first panel 50*a* if the proper swing path is not taken.

Figure 6:
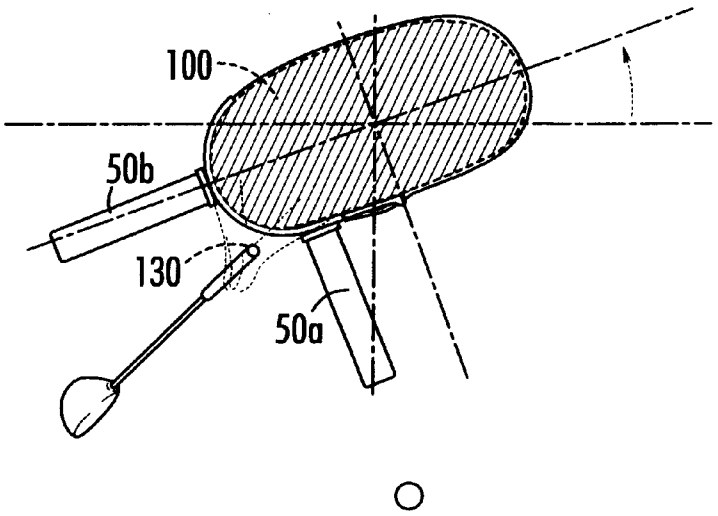
FIG. 6 is a top view of a user using golf training aid during the follow through of the swing, according to a preferred embodiment of the present invention.
Figure 5:
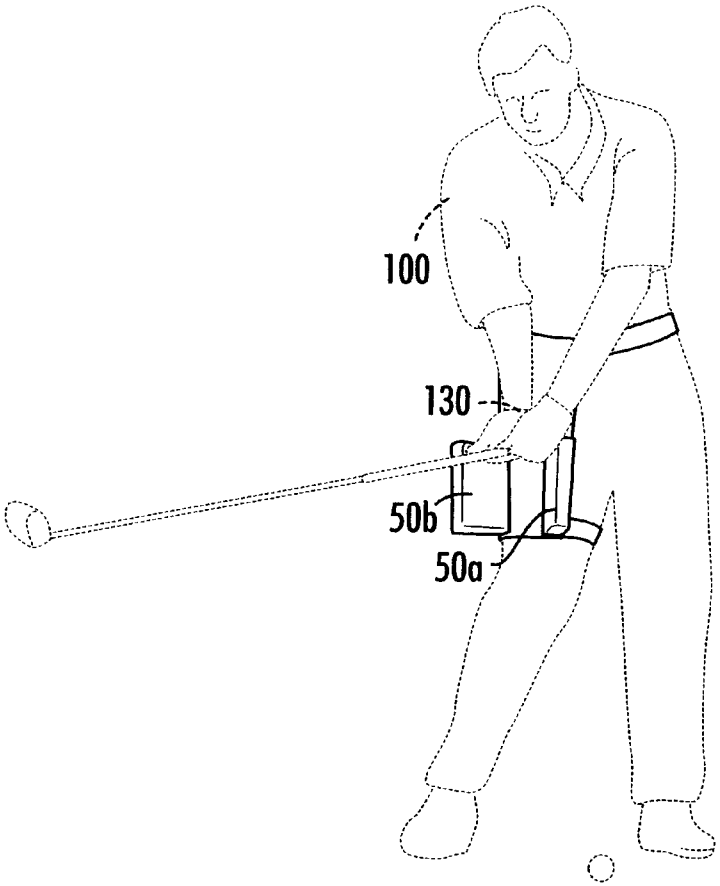
FIG. 5 is a side view of a user using golf training aid during the follow through of the swing, according to a preferred embodiment of the present invention.

Referring to FIGS. 5 and 6, first panel 50*a* and second panel 50*b* are positioned on sheet 40 such that the hands 130 of the user 100 pass between first panel 50*a* and second panel 50*b* during the follow through of the swing, without contacting either first panel 50*a* or second panel 50*b*. In the event that the user does not properly time the rotation of hips with the movement of hands 130 the user 100 will contact either first panel 50*a* or second panel 50*b* with his/her hands.

It will be apparent to those skilled in the art that many changes and substitutions can be made to the preferred embodiment herein described without departing from the spirit and scope of the present invention.

What is claimed is:

1. A golf training aid for use by a golfer when hitting a golf ball with a golf club, said training aid comprising:

a sheet having a top end and a bottom end;

first means for attaching said sheet to a golfer, said first mean attaching said sheet to a leg of said golfer;

second means for attaching said sheet to said golfer, said second means attaching said sheet to the waist of said golfer; and a first panel mounted to said sheet, said first and said second attaching means causing said sheet and said first panel to rotate with the hips of said golfer during a golf swing, said first panel moving from a position perpendicular to the intended flight path of a golf ball to a position parallel to the intended flight path of a ball as said golfer swings, said first panel being positioned on said sheet so that said golfer does not make contact with said first panel in a proper swing, said first panel dimensioned to make contact with said golfer so that said golfer receives tactile feedback from said panel of an improper golf swing.

2. The golf training aid as recited in claims 1, further comprising a second panel attached to said sheet in a position perpendicular to said first panel, said second panel being positioned on said sheet so that said golfer does not make contact with said second panel in a proper swing, said second panel dimensioned to make contact with said golfer so that said golfer receives tactile feedback from said panel of an improper golf swing.

3. The golf training aid as recited in claim 1, wherein said first attaching means is a leg strap.

4. The golf training aid as recited in claim 1, wherein said second attaching means is a belt.

5. The golf training aid as recited in claim 3, wherein said leg strap is attached to said bottom end of said sheet.

6. The golf training aid as recited in claim 4, wherein said belt is attached to said top end of said sheet.

7. The golf training aid as recited in claim 1, wherein said first panel is detachably mounted to said sheet.

8. The golf training aid as recited in claim 1, wherein said first panel is rectangular.

9. The golf training aid as recited in claim 1, wherein said tactile feedback from said first panel comprises:

an improper backswing tactile signal, said improper backswing tactile signal being provided by said first panel contacting at least one hand of said golfer during an improper backswing; and a first improper forward swing tactile signal, said first improper forward swing tactile signal being provided by said first panel contacting at least one hand of said golfer during an improper forward swing.

10. The golf training aid as recited in claim 2, wherein said tactile feedback from said second panel is a second improper forward swing tactile signal, said second improper forward swing tactile signal being provided by said second panel contacting at least one hand of said golfer during an improper forward swing.

11. A golf training aid, said training aid comprising:

a strap capable of attachment to the leg of a user, a sheet carried by said strap; and a first panel carried by said sheet for signaling that said user has moved a club during a backswing in a path that is not parallel with the intended ball flight path and for signaling that said user has insufficient hip rotation during a forward swing, said first panel radially extending from said sheet when said sheet is attached to said user.

12. A golf training aid, said training aid comprising:

a strap capable of attachment to the leg of a user;

a sheet cared by said strap;

a first panel carded by said sheet for signaling that said user has moved a club during a backswing in a path that is not parallel with the intended ball flight path and for signaling that said user has insufficient hip rotation during a forward swing, said first panel radially extending from said sheet when said sheet is attached to said user; and a second panel carried by said sheet for signaling that said user has insufficient hip rotation during a forward swing, said second panel radially extending from said sheet when said sheet is attached to said user.

13. The golf training aid as recited in claim 11, further comprising a belt attached to said sheet, said belt for attaching said sheet to said user's waist.

14. The golf training aid as recited in claim 12, further comprising a belt attached to said sheet, said belt for attaching said sheet to said user's waist.

* * * * *